United States Patent [19]

Smith

[11] 3,937,923

[45] Feb. 10, 1976

[54] ELECTRIC CARTRIDGE HEATER WITH METAL SLEEVE ADAPTER

[75] Inventor: Herman P. Smith, Monroeville, Pa.

[73] Assignee: Emerson Electric Company, St. Louis, Mo.

[22] Filed: Apr. 28, 1975

[21] Appl. No.: 572,054

[52] U.S. Cl. ..... 219/523; 29/234; 219/201; 210/530; 219/536; 308/244; 285/419; 403/367

[51] Int. Cl.[2] ..... H05B 3/06

[58] Field of Search ..... 219/200, 201, 205, 221, 219/229, 523, 530, 535, 536, 540, 541, 544; 29/198, 234, 401, 403, 446, 450, 451, 525, 526; 285/4, 417, 418, 419, 421; 403/365; 403/367, 368, 369, 370; 165/180, 185; 338/241; 308/244

[56] References Cited

UNITED STATES PATENTS

| | | | |
|---|---|---|---|
| 1,025,843 | 5/1912 | Stanley | 219/530 X |
| 1,026,363 | 5/1912 | Parkhurst | 219/530 X |
| 1,353,965 | 9/1920 | Kuhn et al. | 219/536 X |
| 1,728,181 | 9/1929 | Gould | 219/540 X |
| 2,505,625 | 4/1950 | Nordstrom | 403/367 X |
| 2,551,770 | 5/1951 | Smith | 219/205 |
| 3,304,408 | 2/1967 | Finch et al. | 219/544 |
| 3,412,231 | 11/1968 | McElligott | 219/201 |
| 3,835,615 | 9/1974 | King, Jr. | 185/4 X |
| 3,861,815 | 1/1975 | Landaeus | 403/370 |

*Primary Examiner*—Volodymyr Y. Mayewsky
*Attorney, Agent, or Firm*—Michael Williams

[57] ABSTRACT

Cartridge heaters are most frequently used for heating metal parts by insertion into bores in such parts. Such heaters are manufactured in various diameters to closely fit within complementary bores to provide heat according to required specifications. My invention makes it possible to use a heater of known sheath diameter in bores of larger diameter, by use of metal sleeve means which have an inside diameter to closely receive the heater and an outside diameter to closely fit within the bore.

5 Claims, 3 Drawing Figures

ELECTRIC CARTRIDGE HEATER WITH METAL SLEEVE ADAPTER

BACKGROUND AND SUMMARY

Manufacturers of electric cartridge heaters have long had the problem of producing heaters of various diameters to fit within complementary bores of a size specified by a user, and this caused the manufacturer to stock a large amount of heaters in each diameter. On the other hand, the user of the heater frequently found that the part to be heated had been designed so that its bores were larger than the diameter of the heater on hand, or that the bores had been improperly drilled to a larger diameter, and this caused delay in use of the apparatus until proper diameter heaters could be obtained.

Cartridge heaters are frequently used to heat dies formed of steel, aluminum or other metal. If the metal sheath of the heater is in close engagement with the bore wall surface, the interengaging parts sometimes are fused or welded together in the event the cartridge heater fails, and this makes it difficult to remove the heater without affecting the dies. By use of my invention, this is overcome since the cartridge sheath would tend to weld to the sleeve, rather than to the bore surface, and the assembly may be removed from the bore without affecting the dies.

A further advantage of my invention is that it provides a method of conversion from the present measurement system to the metric system by sizing sleeves to suit. Generally, the invention effects a cost savings and means of standardization by a conversion kit method.

My invention eliminates the problems and accomplishes the advantages noted above by utilizing metal sleeve means in combination with a cartridge heater, the sleeve means having an inside diameter to closely receive the sheath of a cartridge heater, and having an outside diameter to closely fit within the larger diameter bore. The sleeve means is preferably made up of a plurality of sleeves of identical length, each sleeve being shorter than the full length of a heater, except a heater of minimum length, so that a plurality of sleeves may be used, in number to cover the various lengths to which the heaters are made.

DESCRIPTION OF THE DRAWING

In the drawing accompanying this specification and forming a part of this application, there is shown, for purpose of illustration, an embodiment which my invention may assume, and in this drawing.

DESCRIPTION OF THE PREFERRED EMBODIMENT

Figure 1:
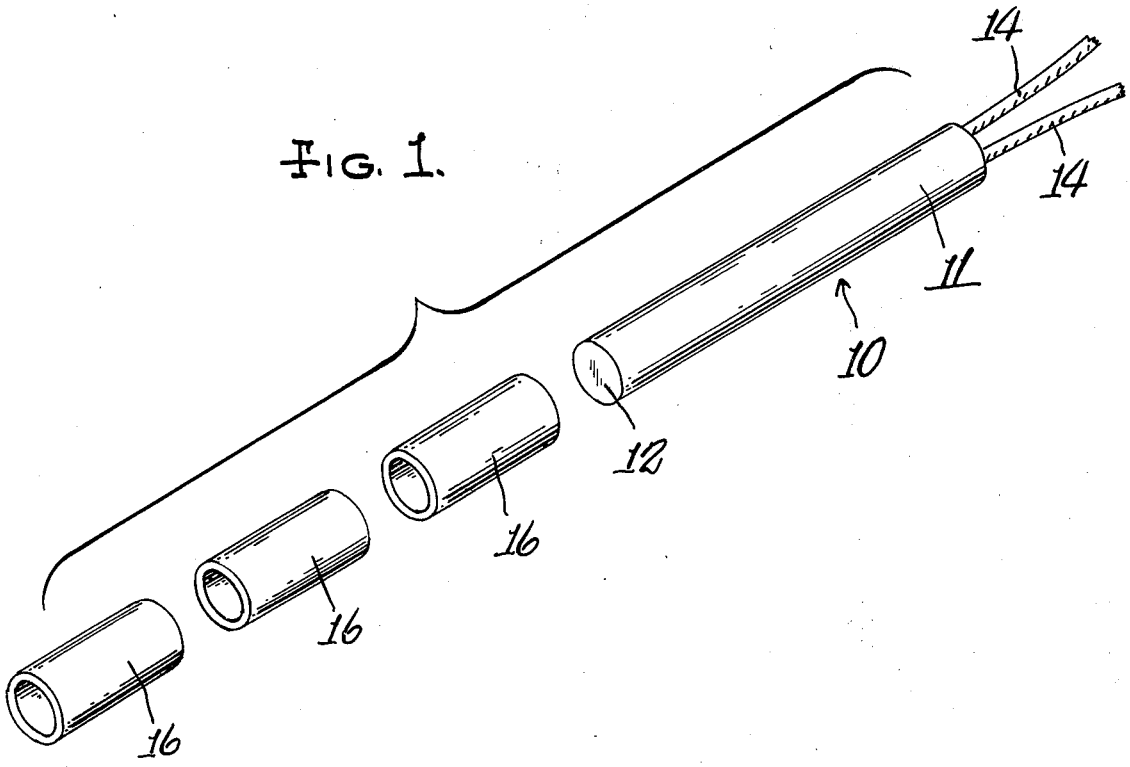
FIG. 1 is a perspective view of a cartridge heater, and a plurality of sleeves in separated relation.

The cartridge heater 10 may be of any commercially availabe type, such as that manufactured by the Edwin L. Wiegand Division of Emerson Electric Co. Such heaters comprise a metal sheath 11 in which a resistor coil is embedded within refractory material. One end of the sheath is usually hermetically sealed by a closure disc 12. Electrical leads 14—14 extend out of the other end of the sheath, through an end seal 15, to connect the resistor coil with a source of electrical energy.

The aforesaid company manufacturers cartridge heaters in standard diameters of ⅜, ½, ⅝, and ¾ inch diameters (9.525, 12.7, 15.875, and 19.05 millimeters respectively) although heaters of other diameters have been manufactured. Many of such cartridge heaters have identical (or substantially identical) electrical ratings and lengths, but vary only in diameter. Since use of cartridge heaters in dies and press platens are usually low temperature applications, all cartridge heaters could be of the ⅜ inch diameter, of low watt density, and sleeved for larger diameter bores where required. Thus, only a single diameter cartridge heater, and a kit of low-cost sleeves, would meet most of the requirements of a user.

I have determined that only ⅜ inch and ¾ inch diameter cartridge heaters would need to be stocked since, by proper sleeving, the majority of uses could be satisfied. Through use of my invention, cartridge heaters of these diameters may be adapted to fit bores of larger diameters, by applying sleeve means thereover, the sleeve means having an internal diameter to closely receive the cartridge heater and an outside diameter to closely fit within the bore.

Cartridge heaters are manufactured in various lengths, the shortest usually having a sheath length of 1¼ inches (31.75 millimeters). I have found it preferable to make the sleeve means in multiples and each sleeve 1¼ inches in length, so that one sleeve will accomodate the shortest sheath length and selected multiples will approximate most standard sheath lengths.

Figure 2:
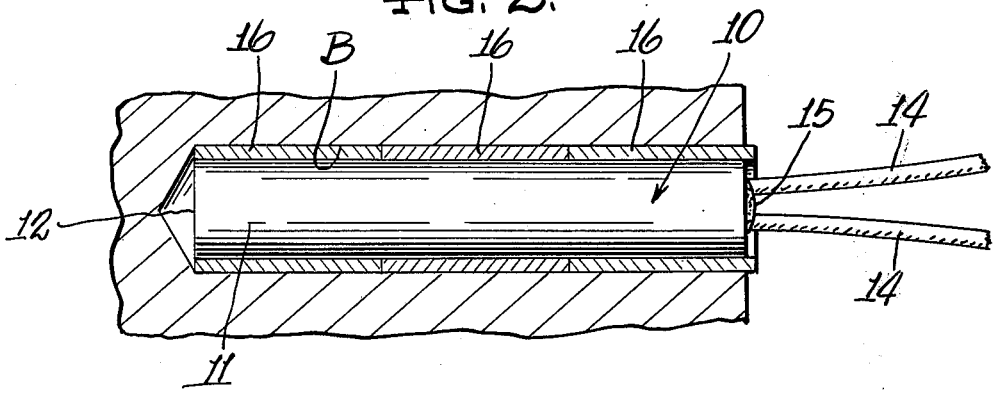
FIG. 2 is a fragmentary sectional view through a metal part to be heated, showing the cartridge heater in elevation and the sleeves disposed between the heater and the bore in the metal part.
Figure 3:
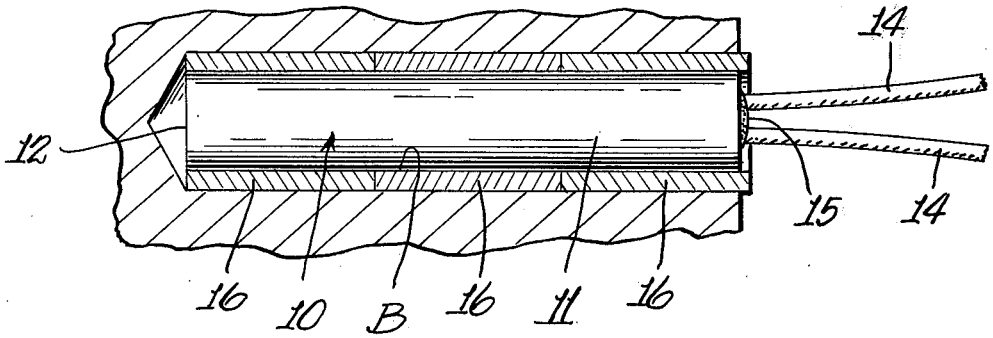
FIG. 3 is a sectional view similar to FIG. 2 but showing sleeves to accomodate the heater to a larger diameter bore.

In FIGS. 1 and 2, three sleeves 16 are shown to accommodate a cartride heater having a sheath length of 3¾ inches (about 9.5 centimeters). It is important that the sleeves be in sufficient multiples to extend at least the full length of the heater, to avoid hot spots between the bore B and the heater. As suggested in FIG. 2, there is no harm in having a sleeve end extend beyond the end of the cartridge heater.

Because it is preferable to provide a sliding fit between the cartridge heater sheath and the sleeves for ease of installation, my invention is particularly useful in combination with cartridge heaters having a relatively low watt density such as, for example, 50 watts per square inch or lower. In watt densities considerably higher, such as, for example, 90 watts per square inch, a very close fit is required between the cartridge heater and the bore in order to insure for high heat transfer.

Although the sleeves 16 may be formed of any metal having suitable heat transfer qualities, I have found that sleeves formed of pressed powdered iron will perform properly, and may be produced at low cost. Since the low watt density of the cartridge heater will restrict the sheath temperature to an amount below 750°F, it would be uneconomical to form the sleeves of more expensive metals.

Assuming the cartridge heater shown in the drawings has a ⅜ inch diameter, it may be adapted, by suitable use of sleeves 16, for bores of various larger diameters. For example, the internal diameter of each of the sleeves 16 may be such as to closely slide over the heater sheath, whereas, the external diameter of each sleeve may be such as to closely slide into bores of ½ inch (12.7 millimeters) or ⅝ inch (15.875 millimeters), or ¾ inch (19.05 millimeters). If the cartridge heater has a ¾ inch diameter, each of the sleeves 16 would have an internal diameter to closely slide over the heater sheath and may have an external diameter to closely slide into bores of 15/16 inches (23.8125 millimeters), or 1 inch (25.4 millimeters) or 1¼ inch (31.75 millimeters).

For assembly purposes, the bushings, in predetermined number according to sheath length, may be slid over the cartridge heater and the assembly then inserted into the bore, or the bushings may first be slid into the bore and the cartridge heater thereafter slid into the bushings. To improve thermal conductivity, an iron cement may be interposed between facing surfaces of the cartridge sheath, the bushings and the bore defining wall.

I claim:

1. In combination:

an electric cartridge heater having a metal sheath of a predetermined outside diameter and adapted to have its external wall surface closely fit the wall of a bore in a mass to be heated, means for adapting said cartridge heater to fit in heat transfer relationship within a bore of larger diameter, comprising metal sleeve means having an inside diameter to provide an inside wall surface to closely fit the sheath exterior wall surface, and having an outside diameter to provide an exterior wall surface to closely fit the wall surface of said larger bore, said cartridge heater being produced in various sheath lengths, said sleeve means being formed as multiple sleeves disposed serially in end-to-end abutting relation between facing wall surfaces of said sheath and said bore in number to cover a selected sheath length, and each sleeve being of continuous cross-section and of constant thickness and uniform diameter throughout its length, whereby hot spots between a sleeve and a cartridge heater are minimized.

2. In combination:

an electric cartridge heater having a metal sheath of a predetermined outside diameter and adapted to have its exterior wall surface closely fit the wall of a bore in a mass to be heated, means for adapting said cartridge heater to fit in heat transfer relationship within a bore of a larger diameter, comprising metal sleeve means having an inside diameter to provide an inside wall surface to closely fit the sheath exterior wall surface, and having an outside diameter to provide an exterior wall surface to closely fit the wall surface of said larger bore, said cartridge heater being produced in a minimum sheath length and various longer sheath lengths, said sleeve means being formed as multiple sleeves of equal length, each sleeve having a length equal to said minimum sheath length, and for heaters having longer than minimum sheath length said sleeves being disposed serially in end-to-end abutting relation between facing wall surfaces of said sheath and said bore in number to cover said longer sheath length, and each sleeve being of continuous cross-section and of constant thickness and uniform diameter throughout its length whereby hot spots between a sleeve and a cartridge heater are minimized.

3. In combination:

an electric cartridge heater, having a metal sheath of a predetermined outside diameter and adapted to have its external wall surface closely fit the wall of a bore in a mass to be heated, and a kit of at least two sleeves to accompany said cartridge heater and to adapt the same to fit in heat transfer relationship within bores of larger diameters, each sleeve having an inside diameter to provide an inside wall surface to closely fit over the sheath wall surface, and said sleeves having predetermined different outside diameters to closely fit the wall surface of larger bores having inside diameters complementary to said different outside diameters, each sleeve being of continuous cross-section and of constant thickness and uniform diameter throughout its length, whereby hot spots between a sleeve and said cartridge heater are minimized.

4. The construction according to claim 3 wherein each sleeve is formed of pressed powdered metal.

5. In combination:

an electric cartridge heater having a metal sheath of a predetermined outside diameter and adapted to have its external wall surface closely fit the wall of a bore in a mass to be heated, and sleeve means for adapting said cartridge heater to fit in heat transfer relationship within a bore of larger diameter, said sleeve means having an inside diameter providing an inside wall surface to closely fit over the sheath exterior wall surface, and having an outside diameter providing an exterior wall surface to closely fit within the wall surface of said larger bore, said sleeve means being of continuous cross-section and of constant thickness and diameter throughout the length thereof to minimize hot spots between the sleeve means and cartridge heater, and said sleeve means being formed of pressed iron powder to serve as a low-cost, non-load bearing, thermal transfer mass transversely and longitudinally filling the space between said sheath exterior wall surface and the wall surface of said larger bore.

* * * * *